US005365755A

United States Patent [19]

Schäberle

[11] Patent Number: 5,365,755

[45] Date of Patent: Nov. 22, 1994

[54] CIRCULAR KNITTING MACHINE FOR MANUFACTURING PATTERNED HIGH-PILE KNITTED FABRICS

[75] Inventor: Erwin Schäberle, Gäufelden, Germany

[73] Assignee: Terrot Strickmaschinen GmbH, Stuttgart, Germany

[21] Appl. No.: 156,252

[22] Filed: Nov. 22, 1993

[30] Foreign Application Priority Data

Dec. 14, 1992 [DE] Germany ..... 4242064

[51] Int. Cl.[5] ..... D04B 9/14

[52] U.S. Cl. ..... 66/9 B

[58] Field of Search ..... 66/8, 9 B, 10; 19/98

[56] References Cited

U.S. PATENT DOCUMENTS

| | | | |
|---|---|---|---|
| 3,495,422 | 2/1970 | Miller | 66/9 B |
| 3,896,637 | 7/1975 | Thore | 66/9 B |
| 3,918,273 | 11/1975 | Thore | 66/9 B |
| 3,973,414 | 8/1976 | Golladay et al. | 66/9 B |
| 4,006,609 | 2/1977 | Abler | 66/9 B |
| 4,006,610 | 2/1977 | Thore | 66/9 B |
| 4,007,607 | 2/1977 | Christiansen et al. | 66/9 B |

FOREIGN PATENT DOCUMENTS

| | | |
|---|---|---|
| 2513706 | 10/1975 | Germany . |
| 2560526 | 11/1975 | Germany . |
| 2645643 | 4/1977 | Germany . |

*Primary Examiner*—Clifford D. Crowder
*Assistant Examiner*—John J. Calvert
*Attorney, Agent, or Firm*—Shenier & O'Connor

[57] ABSTRACT

A circular knitting machine for making patterned high-pile knitted fabrics has needles which move up and down in a needle cylinder and a pattern controlled fiber feeding means made up an opening cylinder wheel to which fibers are fed in accordance with a pattern and which transfers fibers to a doffer from which the needles take off fibers and in which the opening cylinder wheel and doffer are moved out of fiber-transferring relationship upon the interruption of fiber feed to the opening cylinder wheel in accordance with said pattern while leaving the needles in fiber take-off relationship with the doffer.

5 Claims, 2 Drawing Sheets

FIG. 2
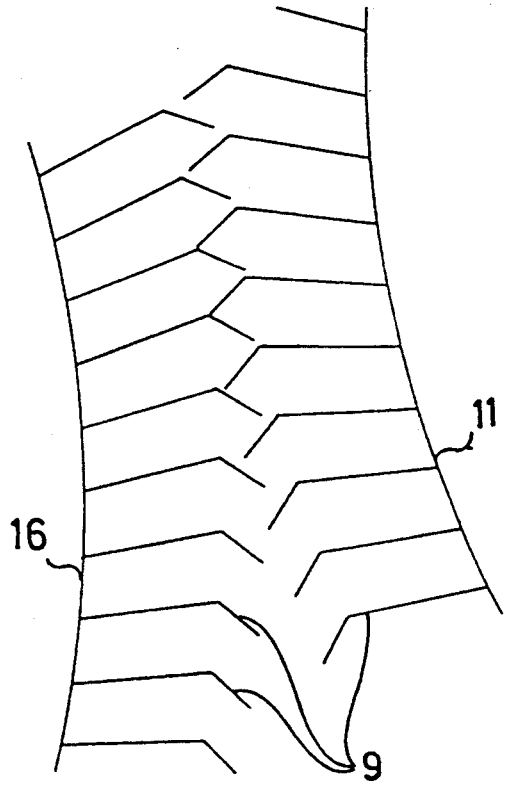
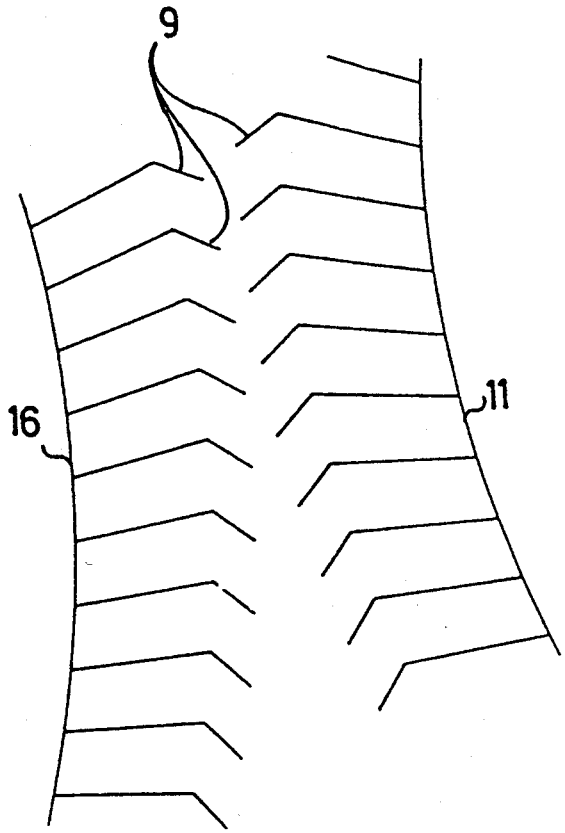
FIG. 3

CIRCULAR KNITTING MACHINE FOR MANUFACTURING PATTERNED HIGH-PILE KNITTED FABRICS

The invention relates to a circular knitting machine for manufacturing patterned high-pile knitted fabrics comprising needles moving up and down in a needle cylinder, a needle selection means operated according to pattern and at least one fiber feeding means controlled according to pattern, whereby the fiber feeding means comprises at least one opening cylinder wheel and one doffer or comb-in wheel, the opening cylinder wheel transfers the fibers onto the doffer and the needles take off the fibers from the doffer.

A high-pile circular knitting machine of this type is known, for example, from DE 26 45 643 C2. A prerequisite for the manufacture of evenly patterned high-pile knitted fabrics on such machines is in the fact that the supply of the fibers supplied by the fiber feeding means, these fibers being in the form of a loose roving, also called slubbing or card sliver, is to be adapted in corresponding time intervals exactly to the number of knitting needles raised according to pattern by the needle selection means in order to achieve a uniform pattern which has, in particular, an even high-pile density. If this adaptation of the fiber supply to the needle selection control is not exact, then irregular fiber distributions in the high-pile results, in particular, "thick places", i.e. places with excess fiber, "thin places", i.e. places with too little fiber, or so-called "shadows", those are—usually parallel to the pattern edge—defined areas which, in relation to neighbouring pile areas within one pattern, have considerably greater pile densities. It is obvious that such differences in fiber distributions in the high-pile of the knitted fabric are highly undesirable and diminish the quality of the produced knitwear considerably.

The object of the invention is to design a generic circular knitting machine such that the fibers in the high-pile of the knitted fabric are evenly distributed and, in particular, that no "shadows" appear.

The object is accomplished in accordance with the invention, in a generic circular knitting machine, in that the opening cylinder wheel and the doffer or comb-in wheel are movable to and fro according to pattern relative to each other between a first and a second position, that the fiber transfer from the cylinder wheel to the doffer is interrupted according to pattern in one of these positions, and that the needles remain in engagement with the doffer in both positions and take off such fibers as remain on the doffer.

It has been found that due to the previously uncustomary relative displacement of cylinder wheel and doffer such that they are disengaged according to pattern, fiber distribution problems can practically be eliminated completely.

The following description of preferred embodiments of the invention serves to explain the invention in greater detail in conjunction with the attached drawings. In these drawings:

FIG. 2 shows a schematic representation of the card clothing of an opening cylinder wheel and a doffer in mutual engagement;

FIG. 3 shows the disengagement of the card clothing of the two wheels from FIG. 2

Figure 1:
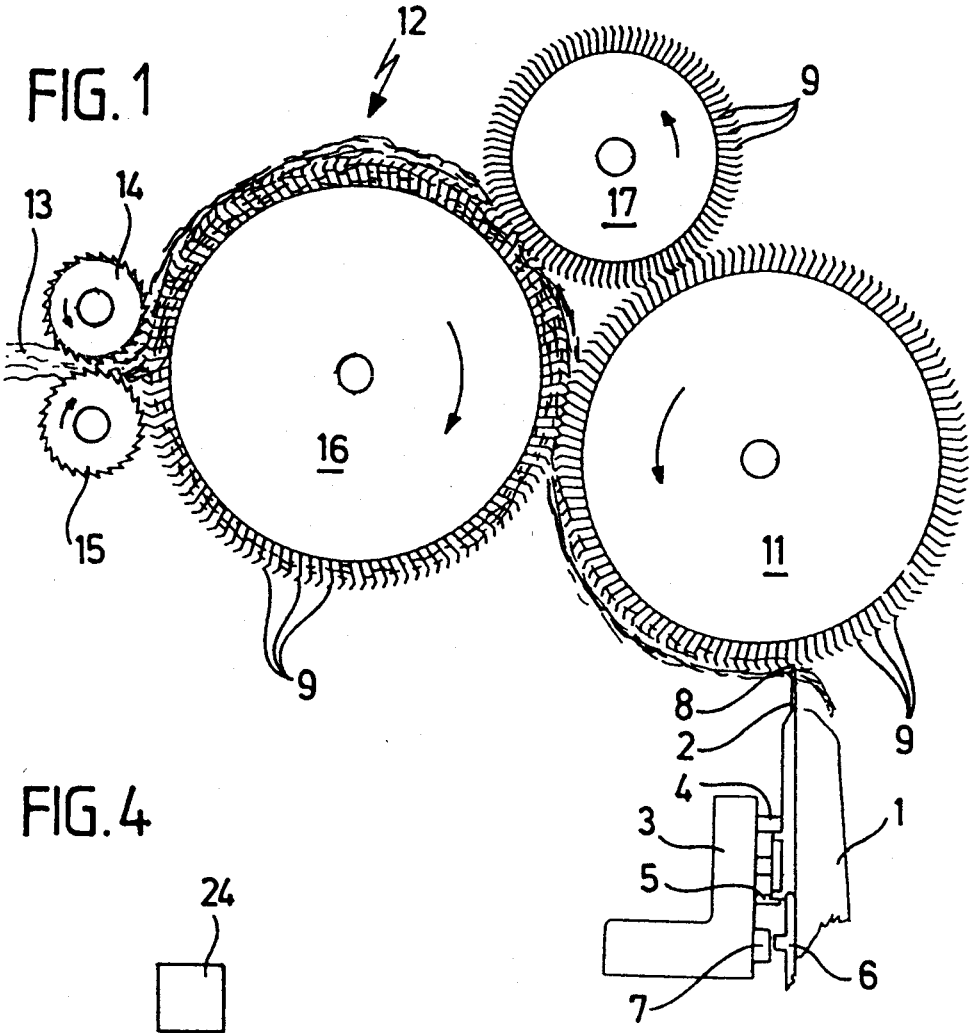
FIG. 1 shows a schematic representation of a fiber feeding means for a high-pile circular knitting machine.

In FIG. 1, the essential components of a circular knitting machine for manufacturing patterned high-pile knitted fabrics are represented schematically. The actual circular knitting machine comprises in the customary manner, a needle cylinder 1 in which knitting needles 2 are mounted on its outer periphery in slots so as to be displaced up and down. A cam ring 3 having cam parts 4,5 is associated with the needle cylinder 1 in the usual manner and this cam ring causes the up and down movement of the knitting needles 2. On the other hand, selector jacks 6 are arranged at the lower ends of the knitting needles 2, these selector jacks acting together with the patterning means 7, for example electromagnetic patterning means, provided at the cam ring 3 such that the raising of the knitting needles 2 can be interrupted as a function of a desired knitting pattern. The needle cylinder 1 is rotatingly driven, whereby the stationary cam ring 3 effects the up and down movement of the knitting needles 2 via its cam parts 4 and 5. As illustrated, the hooks 8 of the knitting needles 2 are in engagement with the carding elements or teasels 9, namely fine, strong, usually small elastic hooks of a doffer 11, which, for its part, is part of a fiber feeding means 12 or "carder" to be described in the following.

The fiber feeding means 12 serves the purpose of supplying fibers, for example in the form of smaller fiber tufts, to the hooks 8 of the knitting needles 2, whereby the individual fiber lengths can be between approximately 20 and 120 mm. These fibers are in the form of a loose slubbing 13, i.e. a roving or card sliver. This card sliver is conveyed to a pair of feed rollers 14, 15 which draw in the roving 13 according to pattern and supply it to an opening cylinder wheel 16 which, like the doffer 11, has a covering of cards 9. At least one of the feed rollers 14, 15 is driven in the manner known per se, for example, with the aid of an electric motor, if necessary, through the intermediary of a preferably self-locking gear. The feed rollers 14, 15 rotate in the direction of the arrows as illustrated. They guide the fibers of the roving 13 onto the carding elements 9 of the opening cylinder wheel 16, where the fibers are stretched, parallelized and distributed evenly in a loose form.

As illustrated, the carding elements 9 of the opening cylinder wheel 16 are in engagement with the carding elements 9 of the the doffer or comb-in wheel 11, and the wheels 11, 16 are driven by motor in the direction of the arrows as illustrated, e.g. via a common belt drive. In this way, the fibers distributed on the opening cylinder wheel 16 are uniformly transferred onto the faster rotating doffer 11. The fibers held evenly and in a loose bundle by the carding elements 9 of the doffer 11 are supplied to the hooks 8 of those knitting needles 2 which are raised at that moment according to pattern by the needle selection means 7 and engage with the card clothing of the doffer 11. During the downward drawing-in of the needles 2, fiber tufts are taken along by their hooks 8 and are interlaced in the basic knitted fabric formed by the needles 2 (from yarns not illustrated) in the form of a high-pile.

The feed rollers 14, 15 as well as the selection means 7 can be controlled according to pattern by a computer. When, for example, during a change to another type of fiber which is supplied by another fiber feeding means (carder) arranged on the circular knitting machine, the rollers 14, 15 of the fiber feeding means represented in FIG. 1 are stopped, the comb-in and the opening cylinder wheels 11, 16 continue rotating. The timed control of the feed rollers 14, 15 must be undertaken such that during the continued rotation of the doffer 11, fibers are taken up exactly in time with the needles 2 raised according to pattern at the point of engagement of the doffer 11. Thereafter, the doffer 11 continues idling, to a certain extent, whereby essentially no further fibers are transferred via the opening cylinder wheel 16 due to the feed rollers 14, 15 being stopped. Remaining fibers which are left on the doffer 11 are transferred back by a working wheel 17, which is also provided with a card clothing 9, from the doffer 11 onto the opening cylinder wheel 16, such that there is no uniform, residual fiber layer, or as little as possible, remaining on the doffer 11.

If the fibers from the roving 13 are now to be transferred anew according to pattern onto the doffer 11 and from there onto the knitting needles 2 to be interlaced into the high-pile knitted fabric produced by the circular knitting machine, the feed rollers 14, 15 are switched on again, at a point in time when the knitting needles 2 have not yet been raised so as to be in an engagement position with the carding elements 9 of the doffer 11, so that a fiber layer can collect before this raising of the knitting needles between the engagement point of the doffer 11 with the opening cylinder wheel 16 and the engagement point of the knitting needles 2 with the doffer 11, this fiber layer being taken over immediately by the correspondingly operated knitting needles 2.

It has been established that a remaining layer of fibers (fiber reservoir) is left on the carding wheels 11, 16 between the small hooks of the card clothing 9. As soon as the feed rollers 14, 15 no longer supply fibers according to pattern, the doffer 11 takes over a percentage of fibers from the remaining layer of the opening cylinder wheel 16 with a time delay. Thereby, after a pile-free knitted area, too many fibers are found on the doffer 11 and too few fibers on the opening cylinder wheel 16. With renewed fiber supply via the feed rollers 14, 15, the fiber layer on the doffer 11 is too large and there is, thus, a zone in the knitted fabric having more dense pile (thick place) parallel to the lower edge, the width of which can correspond approximately to one revolution of the doffer 11. Since the fiber reservoir on the opening cylinder wheel 16 is filled again during renewed fiber supply, a part with too little pile in the knitted fabric (thin place), usually not as strongly defined, results next to the thick place. This phenomenon is dependent on the pattern and is designated with the term "shadows" as mentioned at the outset.

It has been found that in order to solve this problem, the engagement between comb-in and opening cylinder wheels 11, 16 must be completely cancelled during the standstill of the feed rollers 14, 15 effected according to pattern or as a function of the control of these rollers 14, 15 dependent on time, so that no fiber transfer whatsoever takes place from the opening cylinder wheel 16 onto the doffer 11. The needles 2 will of course remove any fibers which remained on the doffer 11 after its engagement with the opening cylinder wheel 16 is broken. Hereby, when the feed rollers 14, 15 are switched on again, no interfering, additional left-over fibers remain on the doffer 11, which could give rise to a "shadow formation" in the high-pile knitted fabric.

FIG. 2 is a schematic illustration of the engagement point of the doffer 11 with the opening cylinder wheel 16. The intermeshing of the hook-like carding elements 9 of the two wheels 11, 16 is easily recognizable.

FIG. 3 shows in a similar representation to FIG. 2 the doffer 11 and the opening cylinder wheel 16, however, separated relative to each other such that the fiber transfer from wheel 16 to wheel 11 is completely interrupted. Stable conditions are created on the doffer 11 with respect to a left-over fiber layer which is still present and these conditions lead to the fact that during renewed fiber supply by switching on the feed rollers 14, 15, irregular fiber densities no longer result in the knitted fabric, in particular, no shadow formations.

Figure 4:
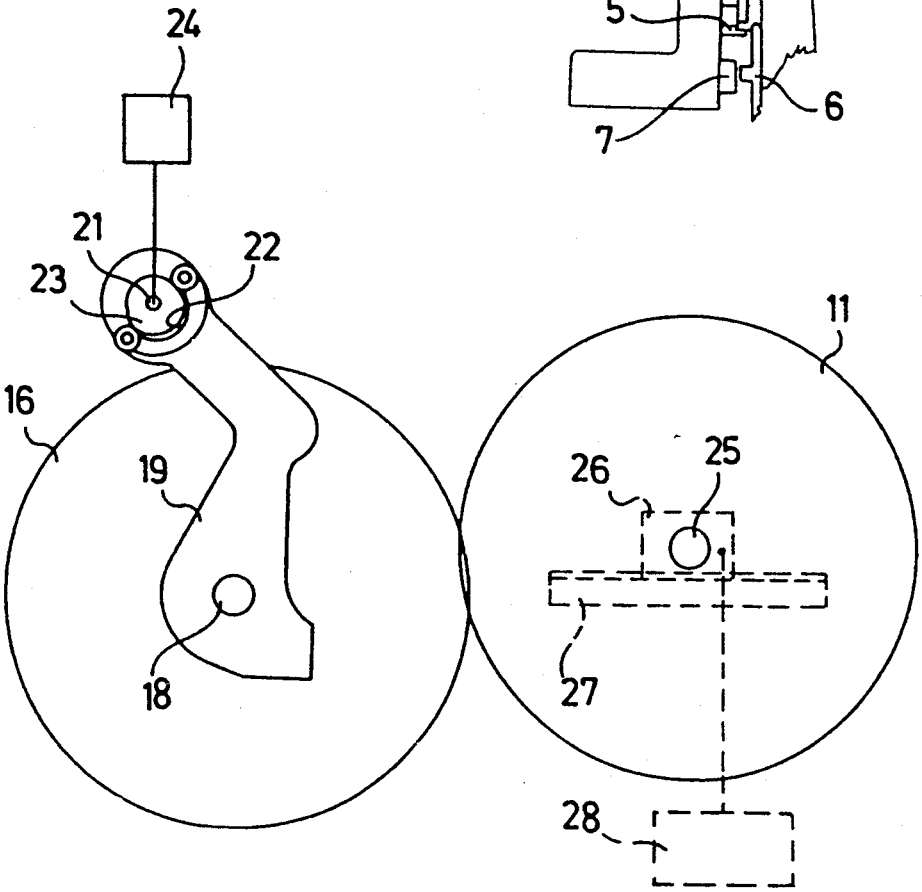
FIG. 4 shows schematic mechanical arrangements of the relative displacement of a cylinder wheel and a doffer such that a fiber transfer between these wheels can be interrupted.

FIG. 4 is a schematic representation of how the relative displacement of doffer 11 and opening cylinder wheel 16 can be mechanically effected in a simple manner such that their card clothings are no longer in engagement.

In a first embodiment, an axle 18 of the opening cylinder wheel 16 is mounted on swivel arms 19 arranged on both sides of the wheel 16 and swivable about an axle 21. The arms 19 each have a relatively large, essentially circular bore 22, in which a cam plate 23 rotates. During rotation of the cam plate 23, the arms 19 swivel such that the carding elements or teasels of the opening cylinder wheel 16 disengage from the carding elements of the doffer 11 (cf. FIG. 3). The cam plate is actuated according to pattern and as a function of the control of the feed rollers 14, 15 also resulting according to pattern by a drive or adjusting means 24 indicated only schematically in FIG. 4.

In another embodiment indicated by broken lines in FIG. 4, an axle 25 of the doffer 11 is mounted on both sides of this wheel on a carriage 26 which is movable to and fro on a sliding guide 27. The carriage 26 can be displaced to and fro by a drive or adjusting means 28 controlled according to pattern, such that the card clothings 9 of the wheels 11, 16 move in and out of engagement as represented in FIGS. 2 and 3.

By means of the arrangements described and schematically represented in FIG. 4, the opening cylinder wheel 16 and the doffer 11 are movable to and fro according to pattern relative to each other between a first and a second position, whereby the fiber transfer from the opening cylinder wheel 16 to the doffer 11 is interrupted according to pattern in one of these positions (FIG. 3).

Moreover, in both positions of the wheels 11, 16, the needles 2 with their hooks 8 can remain in engagement with the doffer 11 and remove fibers which are still on the doffer in the area between the point of engagement of the wheels 11, 16 and the point of engagement of the needle hooks 8 with the doffer 11 when the feed rollers 14, 15 are stopped, so that the doffer 11 can be evenly cleared of its fiber layer.

The mechanical arrangements for relative adjustment of the two wheels 11, 16 schematically illustrated in FIG. 4, only represent two examples of numerous possibilities of how this displacement can be realized in practice. These arrangements can be designed relatively easily since the relative adjustment path of the two wheels 11, 16 in consideration of the actual engagement of the carding elements 9 merely needs to amount to approximately 1 to 1.5 mm. Therefore, merely small forces or torque are necessary and very short switching times are attainable. It is also possible to swivel both wheels simultaneously instead of only one of the wheels 11, 16 in order to bring their card clothings into engagement or out of engagement with each other. The swivel movement can take place via cam plates with the aid of a servomotor or a stepping motor or even a rotary magnet. The swivel movement (by means of the swivel arm 19 illustrated in FIG. 4) can also be performed by means of a lifting magnet or a pressure medium cylinder. Also a loop spring coupling which is controlled by a small electromagnet and indexes a cam plate step-by-step, is suitable for this. Also the force for moving the wheels 11, 16 could be taken directly from the circular knitting machine (drive of the cylinder 1), e.g. via a controlled cam plate.

In high-pile circular knitting machines of the type in question, the drawing-in of the roving or sliver 13 by switching-on and switching-off or coupling and uncoupling the feed rollers 14, 15 for producing patterned knitted fabrics is controlled with the aid of a correspondingly programmed computer. Proceeding on the basis of this control over the drawing-in of the roving, signals for controlling the drive for the displacement of the doffer 11 and the opening cylinder wheel 16 between their two positions, if necessary with corresponding time-delay, can be derived in a simple manner.

The working wheel 17 described and represented in FIG. 1 is not absolutely necessary, but can also be omitted without unfavourably influencing hereby the advantageous effect attained by the relative displacement of the comb-in and opening cylinder wheels 11 and 16, respectively. Thereby, less wear and tear and less fiber-loss, as well as a price reduction of the carder results.

When a control of the circular knitting machine according to pattern is in question in the aforementioned, this is to be understood not only as the alternating supply of the fiber rovings 13 of various colours or various lengths of fibers of different cards distributed around the needle cylinder 1, but also the setting of various knitting patterns or combinations as well as the fabrication of places in the knitted fabric that do not have any pile.

What is claimed is:

1. A circular knitting machine for manufacturing patterned high-pile knitted fabrics including needles moving up and down in a needle cylinder and at least one fiber feeding means controlled according to a pattern, said fiber feeding means comprising at least one opening cylinder wheel to which fibers are fed and one doffing wheel, said opening cylinder wheel transferring fibers fed thereto onto said doffer and said needles take off fibers from the doffer, wherein the improvement comprises means mounting said opening cylinder wheel (16) and said doffer (11) for relative movement between a first position in which said opening cylinder wheel transfers fibers onto said doffer and a second position in which transfer of fibers from said opening cylinder wheel to said doffer is interrupted and means for moving said opening cylinder wheel and said doffer to said second position upon the interruption of fiber feed to said opening cylinder wheel in accordance with said pattern, said needles (2) adapted to take off fibers from said doffer in both said first and second positions.

2. A circular knitting machine according to claim 1, wherein the improvement further comprises that the opening cylinder wheel (16) and the doffer (11) each have radially projecting carding elements (9) being in mutual fiber-transferring engagement in the one position of these wheels (11, 16) and disengaged in the other position of the wheels (11, 16), so that the fiber transfer is interrupted.

3. A circular knitting machine as in claim 1 in which the improvement further comprises that said mounting means comprises a displaceable support (19, 26) for said opening cylinder wheel and said moving means comprises a pattern controlled adjusting means (24, 28) for moving said displaceable support.

4. A circular knitting machine according to claim 3, wherein the improvement further comprises that the support is a swivel arm (19).

5. A circular knitting machine according to claim 3, wherein the improvement further comprises that the support is a displaceable carriage (26).

* * * * *